United States Patent [19]

Bertrams

[11] Patent Number: 4,571,929

[45] Date of Patent: Feb. 25, 1986

[54] DEVICE FOR THE DOSAGE AND INJECTION OF A SMALL QUANTITY OF LIQUID INTO THE SPLICING AIR OF A PNEUMATIC YARN SPLICING DEVICE

[75] Inventor: Josef Bertrams, Wegberg, Fed. Rep. of Germany

[73] Assignee: W. Schlafhorst & Co., Moenchengladbach, Fed. Rep. of Germany

[21] Appl. No.: 626,407

[22] Filed: Jun. 29, 1984

[30] Foreign Application Priority Data

Jul. 2, 1983 [DE] Fed. Rep. of Germany ..... 3323884

[51] Int. Cl.[4] ..... D01H 15/00

[52] U.S. Cl. ..... 57/22

[58] Field of Search ..... 57/22, 297

[56] References Cited

U.S. PATENT DOCUMENTS 3,474,615 10/1969 Irwin et al. ..... 57/22 X
3,643,417 2/1972 Irwin ..... 57/22 X
3,822,538 7/1974 Cardell ..... 57/22

*Primary Examiner*—Donald Watkins
*Attorney, Agent, or Firm*—Herbert L. Lerner; Laurence A. Greenberg

[57] ABSTRACT

The compressed-air tubing (5) leading to the splicing chamber (1) of the yarn splicing device is provided with a combined dosing and atomizing valve (7) through which the splicing air passes and which can be actuated by the splicing air injected. The dosing and atomizing valve (7) has a dosing chamber (22) which is connected alternately to a container of liquid and to the splicing air passing through the valve (7). The splicing air injected encloses the valve-cone (19) like a ring, thereby dragging along and atomizing the pre-dosed liquid.

3 Claims, 4 Drawing Figures

DEVICE FOR THE DOSAGE AND INJECTION OF A SMALL QUANTITY OF LIQUID INTO THE SPLICING AIR OF A PNEUMATIC YARN SPLICING DEVICE

The invention refers to a device for the dosage and injection of a small quantity of liquid into the splicing air of a pneumatic yarn splicing device.

As is known, the object of pneumatic yarn splicing devices is to join together yarn ends by loosening the fibres in the yarns and joining the fibres thus loosened with a splice through one or several blasts of compressed air. To achieve greater success in making such spliced joints and to make the spliced joints stronger and better in appearance, a small quantity of liquid can be added to the splicing air. The problem is to dose this small quantity of liquid very accurately, to atomize it and then to introduce it as an air-liquid mixture into the splicing chamber of the pneumatic yarn splicing device.

The object of this invention is to distribute in the splicing air a very accurately dosed small quantity of liquid efficiently and within the shortest time, precisely when the compressed-air blast which is to bring about the spliced joint, occurs. According to the invention, this object is achieved through providing the compressed-air tube leading to the splicing chamber with a combined dosing and atomizing valve through which the splicing air passes and which can be actuated by the injected splicing air.

The advantages obtained from this invention consist in particular of an accurately dosed small quantity of liquid well atomized and well distributed getting into the splicing air, which process can take place in the proximity of the splicing chamber. The very impact wave of the compressed-air blast entering the splicing chamber carries with it the humidity, which makes for better splicing.

Preferable configurations of the invention are described in the subclaims.

The combined dosing and atomizing valve can preferably have a dosing chamber which can be connected alternately with a liquid container and with the splicing air flowing through the valve. The dosage occurs in this case prior to the splicing process, and as soon as the compressed-air blast sets in; the dosed quantity of liquid is shut off from the liquid container and connected directly with the splicing air. The liquid container can be a stationary container mounted above the dosing and atomizing valve. It can, however, also be a feed pipe containing the liquid. The container liquid can be quiescent, but it can preferably also be in permanent motion and, by way of example, flow through the dosing chamber in a continuous stream so that the air contained in the dosing chamber after the splicing process can be carried away quickly. This offers the advantage of making sure that the liquid is dosed accurately even when there is a rapid succession of compressed-air blasts.

Good atomization and thorough mixing of the components is achieved when the combined dosing and atomizing valve is provided with a valve-cone which held in its closed position by spring pressure against a seat, the cone surface of said valve-cone constituting one of the partition walls of the dosing chamber, and when the air-flow is conducted in such a way that, at the lift of the valve-cone from its seat, the splicing air injected encloses the valve-cone like a ring, at the same time dragging along and atomizing the pre-dosed quantity of liquid. Such a dosing and atomizing valve is of very simple design, the valve-cone can be moved by the compressed air injected. The splicing air is brought into contact with the quantity of liquid over a large area resulting in a good distribution of the liquid.

The dosing chamber is being automatically disconnected from the liquid container at the injection of the splicing air, when, according to a further configuration of the invention, a switching member connected to the valve-cone shuts off the connection between the dosing chamber and the liquid container at the lift of the valve-cone from its seat.

An example of a possible configuration of the invention is illustrated in the drawing. By reference to this example, the invention is described and explained in greater detail.

Figure 1:
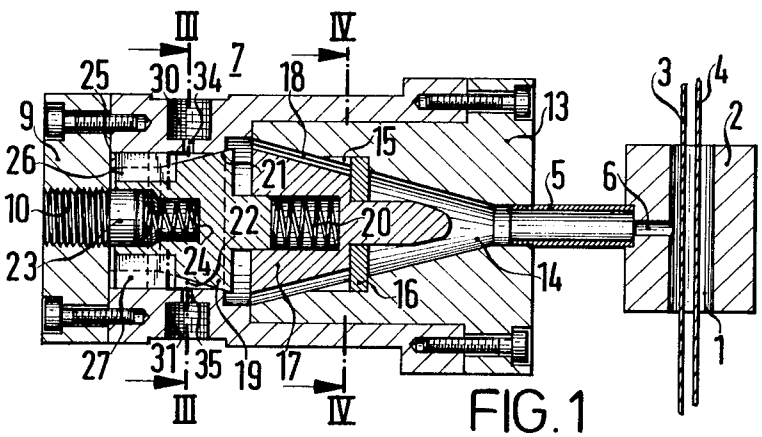
FIG. 1 shows a longitudinal cross-section of a device according to the invention with the dosing and atomizing valve closed.

A pneumatic yarn splicing device, of which the drawing does not show all the details, possesses, among other things, a splicing chamber 1, which is set in a splicer head 2 and which has received two ends of yarn to be joined together. A compressed-air tube 5 leads to the splicing chamber 1 and ends up at an outlet aperture "6" in the splicer head 2.

The compressed-air tube 5 is connected, in the proximity of the splicer head 2, with a combined dosing and atomizing valve 7, through which the splicing air passes and which can be actuated by the splicing air injected. The dosing and atomizing valve 7 has a valve body 8 which is closed with a lid 9 at the side where the compressed-air enters. The lid 9 has a central connecting thread for a short compressed-air tube 11 which leads to an off-on compressed-air source 12. The compressed-air source can for example be connected to, or disconnected from, the system by a two way acting valve, details of which are not shown in the illustration. At its opposite end, the valve body 8 is closed with an insert 13, which has a central cone-shaped opening 14 ending in a threaded connection for the compressed-air tube 5. Cut into the inside of the tapering opening 14 is a ring-shaped groove 15 which holds a guiding star 16. The guiding star 16 in its turn carries an essentially conical insert 17, whereby a tapered annular clearance 18 is formed between the insert 13 and the insert 17.

The insert 17 serves as a guide for a valve-cone 19. FIG. 1 shows that in its closed position the valve-cone 19 under the pressure of a spring 20 rests against a seat 21. Adjacent to the seat 21 is a ring-shaped cell serving as a dosing chamber, the cone surface of the valve-cone 19 forming one of the partition walls of the dosing chamber 22.

At its tail end, the valve-cone 19 has a cylindrical recess and carries a small piston 23 which under pressure of a spring 24 comes to rest against an interior sealing surface 25 of the lid 9, thus producing a sealing effect.

As can be seen from the drawings, the valve-cone 19 has two recesses, one above and one below, in each of which is set a strip shaped switching member 26 or 27 respectively. To receive the switching members 26, 27 the valve body 8 has two guide grooves 28, 29. As the switching members 26, 27 are guided in the guide grooves 28, 29, in which they can move longitudinally, the valve-cone is secured against torsion.

Flush with the dosing chamber 22, the valve body 8 has two tapped holes 30, 31, one above and one below, to receive the tubes 32 or 33 respectively. From the tapped hole 30 an aperture 34 extends to the guide groove 28 and thereby joins the dosing chamber 22. From the tapped hole 31 an aperture 35 extends to the guide groove 29, thereby also joining the dosing chamber 22.

The tubing 32 ends in a liquid container 36. The tubing 33 leads back to the liquid container 36. A liquid pump not shwon in the illustration generates a circulation of the liquid in the direction of the arrow. This circulation is stopped only during the time when the dosing and atomizing valve 7 is open.

So long as the dosing and atomizing valve is closed, as illustrated in FIG. 1, there is a continuous flow of liquid through the dosing chamber 22 with the effect that any air bubbles that may have become locked in the dosing chamber before are carried away in the liquid.

The piston 23 prevents the liquid from escaping into the short compressed-air tube 11. The valve-cone 19 resting against the seat 21 prevents the liquid from passing into the annular clearance 18.

Figure 2:
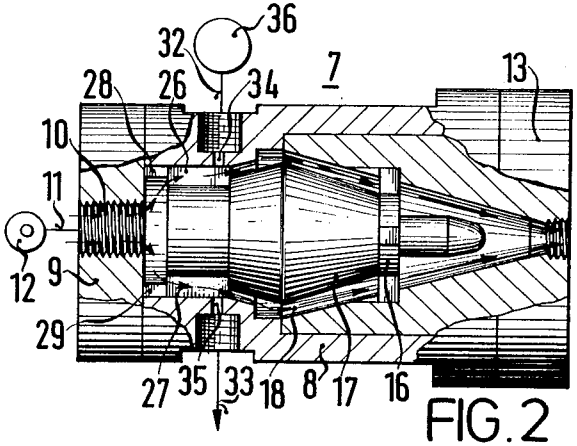
FIG. 2 shows a longitudinal cross-section of an open dosing and atomizing valve.
Figure 3:
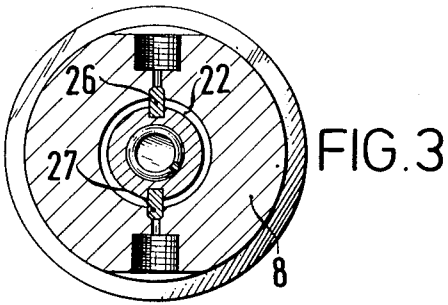
FIG. 3 shows a cross-section of a dosing and atomizing valve along the line III—III indicated in FIG. 1.
Figure 4:
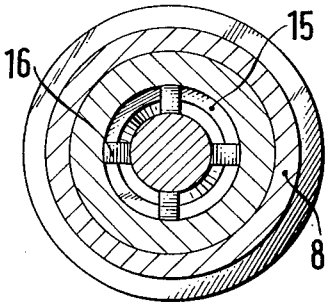
FIG. 4 shows a cross-section of the dosing and atomizing valve along the line IV—IV indicated in FIG. 1.

The moment the compressed-air blast through the short compressed-air tube 11 sets in, the compressed-air at first opens the piston 23, then takes effect on the entire valve-cone 19, pushes the valve-cone 19 forwards against the force of the spring and allows an annular clearance to form between valve-cone 19 and seat 21, as illustrated in FIG. 2. The splicing air flows at a great speed in the direction of the arrows indicated in FIG. 2, thereby spontaneously dragging along the liquid contained in the dosing chamber 22. Thereby, as is shown in FIG. 2, the switching members 26 and 27 are shifted over the apertures 34 and 35, thus shutting off the dosing chamber from the liquid container.

In industrial operation, the splicing air can be blown into the system in two or more blast waves. Each time, the dosing and atomizing valve becomes closed until the following blast, with the liquid flowing each time spontaneously through the dosing chamber 22 at the same time spontaneously removing the air from the dosing chamber. Thus, it is ensured that there is an accurate dosage and atomization of the quantity of liquid even with a rapid succession of the compressed-air blasts.

The invention is not limited to the configuration depicted and described herewith by way of example.

I claim:

1. Device for dosing and injecting a small quantity of liquid into the splicing air entering the splicing chamber of a pneumatic yarn splicing device from a compressed-air source, comprising a compressed-air tube leading to the splicing chamber, a liquid container, and a combined dosing and atomizing valve connected between the compressed-air source and said compressed-air tube for conducting splicing air to said compressed-air tube, said valve having a dosing chamber formed therein receiving a given quantity of liquid, and said valve including means operated by splicing air from the compressed-air source for alternately connecting said dosing chamber to said liquid container and to the compressed-air source for injecting said given quantity of liquid into the splicing chamber.

2. Device as described in claim 1, wherein said combined dosing and atomizing valve includes a valve-cone which is held in its closed position by spring pressure against a seat and whose cone surface constitutes a partition wall of the dosing chamber, the air-flow being conducted in such a way that, at the lift of the valve-cone from its seat, the splicing air injected encloses the valve like a ring thereby dragging along and atomizing the pre-dosed quantity of liquid.

3. Device as described in claim 2, wherein said valve includes a switching member connected to the valve-cone breaking the connection between the dosing chamber and the liquid container, as the valve-cone is lifted from its seat.

* * * * *